US008398425B2

(12) United States Patent
Suzuki et al.

(10) Patent No.: US 8,398,425 B2
(45) Date of Patent: Mar. 19, 2013

(54) BOARD-TO-BOARD CONNECTOR HAVING SLOPED GUIDE SURFACES WITH A COMMON EDGE

(75) Inventors: Hirokazu Suzuki, Yamato (JP); Ryotaro Takeuchi, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/124,363

(22) PCT Filed: Oct. 14, 2009

(86) PCT No.: PCT/US2009/060653

§ 371 (c)(1),
(2), (4) Date: Apr. 14, 2011

(87) PCT Pub. No.: WO2010/045336

PCT Pub. Date: Apr. 22, 2010

(65) Prior Publication Data

US 2011/0201226 A1 Aug. 18, 2011

(30) Foreign Application Priority Data

Oct. 14, 2008 (JP) ..... 2008-265484

(51) Int. Cl.
*H01R 13/64* (2006.01)

(52) U.S. Cl. ..... 439/374

(58) Field of Classification Search ..... 439/74, 439/660, 78, 81, 83, 346, 374
See application file for complete search history.

(56) References Cited

U.S. PATENT DOCUMENTS 6,746,267 B2 6/2004 Fukamachi et al.
6,793,506 B1 * 9/2004 Hirata et al. ..... 439/74
6,976,853 B2 * 12/2005 Goto ..... 439/74
7,118,388 B2 10/2006 Midorikawa et al.
7,264,484 B2 * 9/2007 Takano ..... 439/74
7,425,158 B2 * 9/2008 Ookura ..... 439/660
7,497,697 B2 3/2009 Hoshino et al.
2005/0070137 A1 3/2005 Goto
2006/0035489 A1 2/2006 Goto
2006/0276060 A1 12/2006 Takano
2007/0105408 A1 5/2007 Ookura

FOREIGN PATENT DOCUMENTS

WO PCT/KR2004/000034 9/2004

OTHER PUBLICATIONS

International Search Report and Written Opinion for PCT/US2009/060653, Mar. 12, 2009.

* cited by examiner

*Primary Examiner* — Chandrika Prasad
(74) *Attorney, Agent, or Firm* — Timothy M. Morella

(57) ABSTRACT

A board-to-board connector comprising a first connector and a second connector is disclosed. The first connector has a first housing mounted on first terminals. The second connector is configured to be engaged, by fitting, with the first connector. The second connector has a second housing mounted on second terminals, which are configured to make contact with the first terminals. At least a part of an entrance end portion a concave guide portion is provided with a sloped guide surface formed therein. Due to the insertion of a second fitting guide portion into a concave guide portion, in such a manner that portions of the second fitting guide portion are brought into abutting contact with the sloped guide surface, the first and second terminals are spaced apart from each other in a state where fitting faces of the first and second housings are even with each other.

9 Claims, 12 Drawing Sheets

BOARD-TO-BOARD CONNECTOR HAVING SLOPED GUIDE SURFACES WITH A COMMON EDGE

BACKGROUND OF THE DISCLOSURE

1. Field of the Disclosure

The Present Disclosure relates, generally, to a board-to-board connector, and, more particularly, to a board-to-board connector having such a configuration that when a fitting face of a first housing of a first connector is even with a fitting face of a second housing of a second connector, first terminals of the first connector are spaced apart from second terminals of the second connector, so that when the fitting face of the first housing is brought to slide on the fitting face of the second housing during the fitting operation, the first terminals do not make abutting contact with the second terminals, thereby preventing damage.

2. Description of the Related Art

Board-to-board connectors are typically used to couple pairs of parallel circuit boards with each other. Such connectors are attached, by fitting, to respective opposing surfaces of the circuit boards so that the boards are electrically connected to each other. An example of such a board-to-bard connector may be illustrated in Japanese Patent Application No. 2008-084795.

Additionally, FIG. 12 illustrates a cross-sectional view of a conventional board-to-board connector. In FIG. 12, first housing 811 houses a first connector mounted in first circuit board 891, and second housing 911 houses a second connector mounted in second circuit board 991. When the first and second connectors are engaged together by fitting, first circuit board 891 and second circuit board 991 are electrically connected to each other.

First housing 811 is provided with concave hollow portion 812, in which plurality of first terminals 861 are mounted. Each first terminal 861 is provided with tail portion 862, soldered to a connection pad of first circuit board 891, first contact portion 864 and second contact portion 865—configured to make contact with second terminal 961 of the second connector. Similarly, plurality of second terminals 961 is mounted in second housing 911. Each second terminal 961 is provided with tail portion 962, soldered to a connection pad of second circuit board 991, and contact portion 964—configured to make contact with first terminal 861 of the first connector.

Further, second housing 911 is formed with convex insertion portions 912 at longitudinally spaced both ends thereof, and first housing 811 is formed with projecting portions 822 at longitudinally spaced both ends thereof. When the first and second connectors are engaged together, convex insertion portion 912 is received in concave portions formed in projecting portion 822, so that the positioning between the first and second connectors is achieved. Moreover, one tapered portion is formed in an entrance corner portion of the concave portion formed in projecting portion 822, and another is also formed in a front corner portion of convex insertion portion 912. Therefore, convex insertion portion 912 can be smoothly guided to fit into the concave portion of projecting portion 822, thereby making it easy to perform the positioning between the first and second connectors.

However, in the conventional board-to-board connector, since first terminals 861 and second terminals 961 rub against each other during the fitting operation, first terminals 861 and the second terminals 961 might be damaged. When the first and second connectors are engaged together, since they are respectively mounted on surfaces of first circuit board 891 and second circuit board 991, which have large cross-sectional areas, oftentimes, an operator may be requested to perform the fitting operation while being unable to visually recognize a fitting face of first housing 811 and a fitting face of second housing 911. In such a case, the operator may adjust the position of second housing 911 relative to first housing 811 by mutually sliding the fitting faces of first housing 811 and second housing 911 until convex insertion portion 912 comes to enter into the concave portion of projecting portion 822.

At this stage, on the fitting face of first housing 811, only the tapered portion is formed in the entrance corner portion of the concave portion formed in the respective projecting portion 822. Moreover, on the fitting face of second housing 911, only the tapered portion is formed on each of the front corner portions of the convex insertion portion 912. However, there is no specific member for facilitating the entering of convex insertion portion 912 into the concave portion of projecting portion 822. For this reason, when the fitting face of first housing 811 is made to slide on the fitting face of second housing 911, first and second terminals 861, 961 are brought into abutting contact, and may rub against each other, potentially causing damage. This increases both the difficulty and time to perform the fitting operation.

SUMMARY OF THE DISCLOSURE

Therefore, it is an object of the Present Disclosure to obviate the above-described problems encountered by the conventional board-to-board connector, and to provide a board-to-board connector having such a configuration that when a fitting face of a first housing of a first connector is even with a fitting face of a second housing of a second connector, first terminals of the first connector are spaced apart from second terminals of the second connector, so that when the fitting face of the first housing is brought to slide on the fitting face of the second housing during the fitting operation, the first terminals do not abut the second terminals, thereby preventing damage to the first and second terminals. Consequently, the board-to-board connector reduces the difficulty of the fitting operation, and allows it to be completed in a short period of time and in an accurate manner, while realizing a high degree of operability and reliability of the board-to-board connector.

Therefore, a board-to-board connector includes a first connector having a first housing mounting thereon first terminals, the first housing comprising: an island portion formed, on an upper side thereof, with a fitting face; concave insertion portions formed on both sides of the island portion; side wall portions formed on both sides of each of the concave insertion portions, first fitting guide portions arranged at both ends in a longitudinal direction of the island portion; and concave guide portions formed in the first fitting guide portions, a second connector configured to be engaged, by fitting, with the first connector, the second connector having a second housing mounting thereon second terminals configured to make contact with the first terminals, the second housing comprising: a recessed cavity portion in which the island portion is inserted; protrusive convex portions formed on both sides of the recessed cavity portion to have fitting faces formed thereon, and provided to be inserted in the concave insertion portions; and second fitting guide portions arranged at both ends in the longitudinal direction of the recessed portion to be inserted in the concave guide portions, wherein: at least a part of an entrance end portion of each of the concave guide portions is provided with a sloped guide surface formed therein, and due to insertion of the second fitting guide portions in the concave guide portions so that portions of the second fitting guide portions are brought into abutting contact with the sloped guide surfaces, the first terminals and the second terminals are spaced apart from each other in a state where the fitting face of the first housing and the fitting faces of the second housing are even with each other.

The board-to-board connector additionally has such a configuration that the fitting face of the first housing is formed to be flat, and none of the portions of the first terminals protrude out from the fitting face, and that the fitting faces of the second housing are formed to be flat, and none of the portions of the second terminals protrude out from the fitting faces.

The board-to-board connector further has such a configuration that each of the first terminals is provided with a first and second contact portion defining therebetween a mutual space which is elastically changeable, and that when the protrusive convex portions are inserted in the concave insertion portions, respective one of the second terminals comes to be positioned between the first contact portion and the second contact portion.

The board-to-board connector still further has a configuration that each of the sloped guide surfaces is provided with an anterior sloped surface portion having a gentle slope and a posterior sloped surface portion having a steep slope with respect to the fitting face of the first connector.

Thus, the board-to-board connector has a configuration in which, even when the fitting face of the first housing of the first connector is even with the fitting face of the second housing of the second connector, the first terminals of the first connector are spaced apart from the second terminals of the second connector. Owing to such a configuration, even when the fitting face of the first housing is made to slide on the fitting face of the second housing in the course of a fumbling operation for fitting of the first and second connectors, the first terminals might not make abutting contact with the second terminals, and thus damages to the first terminals and the second terminals can be certainly prevented. Therefore, the fumbling operation for fitting is made easy and therefore, it is possible to complete the fitting operation in a rather short period of time and in an accurate manner. Accordingly, it is possible to provide good operability and high reliability of the board-to-board connector.

BRIEF DESCRIPTION OF THE DRAWINGS

The organization and manner of the structure and operation of the present disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the figures, and will be described herein in detail, specific embodiments, with the understanding that the disclosure is to be considered an exemplification of the principles of the present disclosure, and is not intended to limit the present disclosure to that as illustrated. In the embodiments illustrated herein, representations of directions such as up, down, left, right, front, rear and the like, used for explaining the structure and movement of the various elements of the present disclosure, are not absolute, but relative. If the description of the position of the elements changes, it is assumed that these representations are to be changed accordingly.

Figure 1:
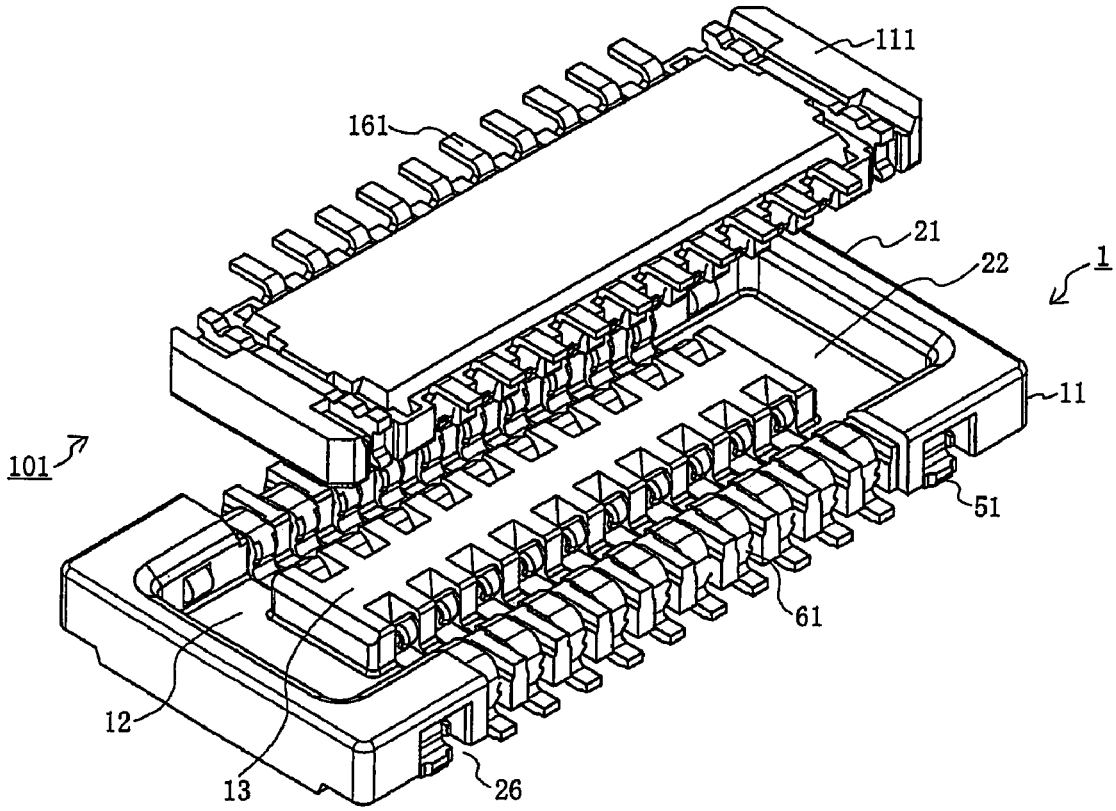
FIG. 1 is a perspective view of first and second connectors of a board-to-board connector, viewed from a fitting face of the first connector, wherein the first and second connectors are not engaged.
Figure 2:
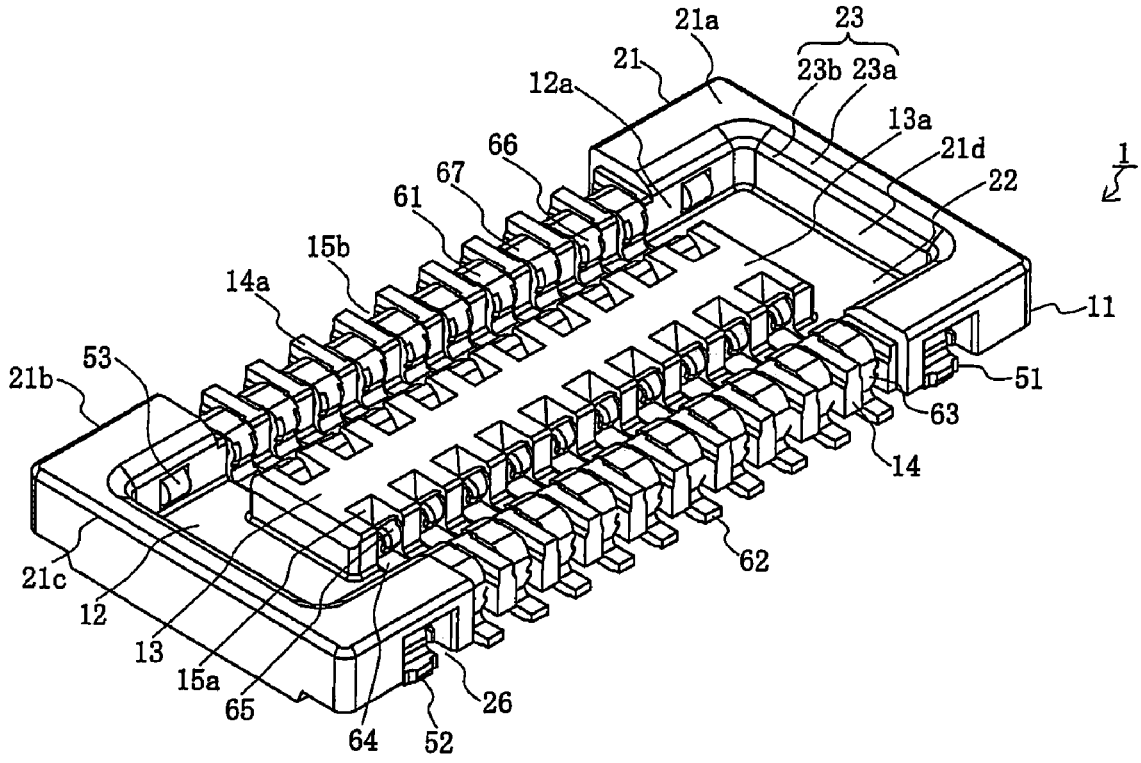
FIG. 2 is a perspective view of the first connector of FIG. 1, viewed from a fitting face.

FIG. 1 is a perspective view of a first and a second connectors of a board-to-board connector according to an embodiment of the Present Disclosure, as viewed from a fitting face of the first connector, illustrating a state where the first and second connectors are not yet engaged together by fitting; and FIG. 2 is a perspective view of the first connector according to the embodiment of the Present Disclosure, as viewed from a fitting face thereof.

In the drawing figures, a first connector, as one of a pair of connectors constituting a board-to-board connector according to the present embodiment, generally designated by reference numeral 1, is a surface-mounted type connector, which is mounted on a surface of a non-illustrated first board. Moreover, a second connector, as the other one of the connectors constituting the pair of board-to-board connector according to the present embodiment, generally designated by reference numeral 101, is a surface-mounted type connector, which is mounted on a surface of a non-illustrated second board. The board-to-board connector according to the present embodiment includes the first connector 1 and the second connector 101, and is configured to electrically connect the first board and the second board to each other. Here, the first board and the second board are printed circuit boards used, for example, in an electronic device or apparatus, and may be any type of board.

In addition, in the present embodiment, representations of directions such as up, down, left, right, front, rear, and the like, used for explaining the structure and movement of each part of the board-to-board connector, and the like, are not absolute, but relative. These representations are appropriate when each part of the board-to-board connector, and the like, is in the position shown in the drawing figures. If the position of the board-to-board connector, and the like, changes, however, it is assumed that these representations are to be changed according to a change in the position of the board-to-board connector, and the like.

The first connector 1 includes a first housing 11 as a connector body integrally formed of an insulating material such as synthetic resin. As will be understood from the drawing figures, the first housing 11 is a generally rectangular parallelepiped member having a generally rectangular, thick plate-like shape. A concave portion 12 having a generally rectangular shape having a surrounded perimeter is formed on a side, i.e., a fitting side (the upper side in FIG. 2), where the second connector 101 is fitted. The first connector 1 has a dimension of about 10.0 mm in length, about 2.5 mm in width, and about 1.0 mm in thickness, and the dimension may be appropriately changed as required. Moreover, a first protrusive convex portion 13 provided as an island portion is formed in the concave portion 12 to be integral with the first housing 11. Furthermore, side wall portions 14 configured to extend in parallel with the first protrusive convex portion 13 are formed at both sides of the first protrusive convex portion 13 to be integral with the first housing 11. In this case, the first protrusive convex portion 13 and the side wall portions 14 protrude upwardly from a bottom portion of the concave portion 12 and extend in the longitudinal direction of the first housing 11. Owing to this configuration, recessed groove portions 12*a*, as a portion of the concave portion 12, being elongated concave insertion portions configured to extend in the longitudinal direction of the first housing 11 are formed at both sides of the first protrusive convex portion 13 to be disposed between the first protrusive convex portion 13 and the side wall portions 14. Although in the example illustrated in the drawing figures, the first protrusive convex portion 13 is singular in number, a plurality of protrusive convex portions may be provided and the number thereof is not particularly limited. In addition, the first protrusive convex portion 13 has a dimension of about 0.6 mm in width, for example, the dimension may be appropriately changed as required.

In this embodiment, first terminal-receiving inside cavities 15*a* having a recessed groove shape are formed on both side surfaces of the first protrusive convex portion 13. Moreover, first terminal-receiving outside cavities 15*b* having a recessed groove shape are formed on an upper surface 14*a* and along both side surfaces of each of the side wall portion 14. Since the first terminal-receiving inside cavities 15*a* and the first terminal-receiving outside cavities 15*b* are connected with each other at a bottom portion of the recessed groove portion 12*a* and are integral with each other, the first terminal-receiving inside cavities 15*a* and the first terminal-receiving outside cavities 15*b* will be collectively referred to as first terminal receiving cavities 15.

The number of first terminal receiving cavities 15 on each side of the first protrusive convex portion 13 is 10 with a pitch of about 0.4 mm, for example. Moreover, the number of first terminals 61 received in the first terminal receiving cavities 15 on each side of the first protrusive convex portion 13 is 10 with a pitch of about 0.4 mm, for example. It should be appreciated that the pitch and the number of the first terminal receiving cavities 15 may be appropriately changed as required.

The first terminals 61 are an integral member formed by applying processing, e.g., punching and bending, to a conductive metal plate. Each of the first terminals 61 is provided with a holding portion 63, a tail portion 62 connected to a lower end of the holding portion 63, an upper connection portion 67 connected to an upper end of the holding portion 63, a second contact portion 66 formed in the vicinity of an inner end of the upper connection portion 67, a lower connection portion 64 connected to the second contact portion 66, and a first contact portion 65 formed in the vicinity of a free end of the lower connection portion 64.

The holding portions 63 are portions that extend in the up-down direction, i.e., in the thickness direction of the first housing 11 to be held by being fitted in the first terminal-receiving outside cavities 15*b*. The tail portions 62 are bent to be connected to the holding portions 63 and extend in the left-right direction, i.e., outwardly in the width direction of the first housing 11 to be connected to connection pads connected to a conductive trace on the first board by means of soldering or the like. The upper connection portions 67 are bent to be connected to the holding portions 63 and extend inwardly in the width direction of the first housing 11. Moreover, the second contact portions 66 having a curved shape and configured to downwardly bend and inwardly protrude are formed at the inner ends of the upper connection portions 67. The lower connection portions 64 are portions having a generally U shape in side view and connected to the lower ends of the second contact portions 66. Furthermore, the first contact portions 65 having a curved shape and configured to bend in an U shape and outwardly protrude are formed at the free ends, i.e., in the vicinity of the inner upper ends of the lower connection portions 64.

The first terminals 61 are fitted into the first terminal receiving cavities 15 from the fitting side to be fixedly secured to the first housing 11 by the holding portions 63 being clamped by the side walls of the first terminal-receiving outside cavities 15*b* in a sandwich manner, which are disposed outside the side wall portions 14.

In the present embodiment, the upper surface 13*a* of the first protrusive convex portion 13 is a fitting face and is configured as a flat or smooth surface. The upper surface 13*a* as the fitting face functions as a reference surface for engagement between the first connector 1 and the second connector 101, together with an upper surface 112*a* of a later-described second protrusive convex portion 112 and an upper surface 122*a* of a later-described second protrusive end portion 122, as a fitting face of the second connector 101. That is, during steps of a fitting operation of fitting the first connector 1 and the second connector 101 to be engaged with each other, even when the first housing 11 of the first connector 1 and the second housing 111 of the second connector 101 are moved to be positioned in close contact with each other, the first connector 1 and the second connector 101 are still in a non-engagement state until the respective fitting faces thereof become even with each other. The fitting engagement between the first connector 1 and the second connector 101 starts when the respective fitting faces thereof become even with each other. Moreover, even when the respective fitting faces thereof become even with each other, the first terminals 61 of the first connector 1 and the second terminals 161 of the second connector 101 are not in abutting contact with each other, but the first terminals 61 and the second terminals 161 make abutting contact when the fitting engagement between the first connector 1 and the second connector 101 is started.

Moreover, none of the portions of the first terminals 61 fixedly secured to the first housing 11 protrude out from the upper surface 13*a* of the first protrusive convex portion 13. Furthermore, in the example illustrated in the drawing figures, the upper surface 14*a* of the side wall portion 14 is formed at a position lower (closer to the first board) than the upper surface 13*a* of the first protrusive convex portion 13. For this reason, an upper surface of the upper connection portion 67 of the first terminal 61 is substantially even with the upper surface 14*a* of the side wall portion 14, but it does not protrude out from the upper surface 13*a* of the first protrusive convex portion 13. Moreover, if the upper surface of the upper connection portion 67 of the first terminal 61 is made lower than the upper surface 14*a* of the side wall portion 14, the upper surface 14*a* of the side wall portion 14 may be made even with the upper surface 13*a* of the first protrusive convex portion 13.

Furthermore, first protrusive end portions 21 as a first fitting guide portion are arranged at both ends in the longitudinal direction of the first housing 11, respectively. A concaved protrusive end portion 22 as a portion of the concave portion 12 is formed in each of the first protrusive end portions 21. The concaved protrusive end portions 22 are generally rectangular concave portions and are connected to both ends in the longitudinal direction of each of the recessed groove portions 12*a*. Moreover, the concaved protrusive end portion 22 functions as a concave guide portion in which a later-described second protrusive end portion 122 of the second connector 101 is inserted in a state where the first connector 1 and the second connector 101 are engaged by fitting together with each other.

Each of the first protrusive end portions 21 is provided with sidewall extension portions 21*b* configured to extend in the longitudinal direction of the first housing 11 from both ends in the longitudinal direction of the side wall portion 14 and an end wall portion 21*c* configured to extend in the short-axis direction of the first housing 11 and having both ends thereof connected to the sidewall extension portions 21*b*. In each of the first protrusive end portions 21, the end wall portion 21*c* and the sidewall extension portions 21*b* connected to both ends of the end wall portion 21*c* form a continuous side wall having an inverted C shape to thereby define three sides of the rectangular concaved protrusive end portion 22.

The upper surface 21*a* of each of the first protrusive end portions 21 is a piece of continuous flat surface having an inverted C-shape extending over the entire range of the end wall portion 21*c* and the sidewall extension portions 21*b* connected to both ends of the end wall portion 21*c* and is formed at a position higher (distant from the first board) than the upper surface 13*a* of the first protrusive convex portion 13.

Moreover, a sloped surface portion 23 as a sloped guide surface is formed in at least a portion of a boundary portion between an inner end of the upper surface 21*a* and an inner side surface 21*d* of the first protrusive end portion 21, that is at least a portion (in the example illustrated in the drawing figures, surrounding three sides) of an entrance end portion of the concaved protrusive end portion 22. The sloped surface portion 23 is provided with an anterior sloped surface portion 23*a* connected to the upper surface 21*a* and having a relatively gentle slope with respect to the fitting face and a posterior sloped surface portion 23*b* having a relatively steep slope with respect to the fitting face while having one end thereof connected to the anterior sloped surface portion 23*a* and the other end thereof connected to the inner side surface 21*d*. Although the anterior sloped surface portion 23*a* and the posterior sloped surface portion 23*b* are flat surfaces in the example illustrated in the drawing figures, they may be curved surfaces. That is, the respective portions of the sloped surface portion 23 may be sloped flat surfaces and may be sloped curved surfaces.

Furthermore, first reinforcing brackets 51 as a reinforcing bracket are attached to the first protrusive end portions 21. The first reinforcing brackets 51 are an integral member formed by applying processing, e.g., punching and bending, to a metal plate and are received and held in first concave bracket holding portions 26 formed in the sidewall extension portions 21*b*. Moreover, tail portions 52 formed at the lower ends of the first reinforcing brackets 51 are connected to fixing pads on the first board by means of soldering or the like. Furthermore, convex engagement portions 53 formed at the upper ends of the first reinforcing brackets 51 are configured to protrude from the inner side surfaces 21*d* to be received in the concaved protrusive end portions 22 so as to be engaged with later-described second reinforcing brackets 151 of the second connector 101 in a state where the first connector 1 and the second connector 101 are engaged by fitting together with each other.

Figure 3:
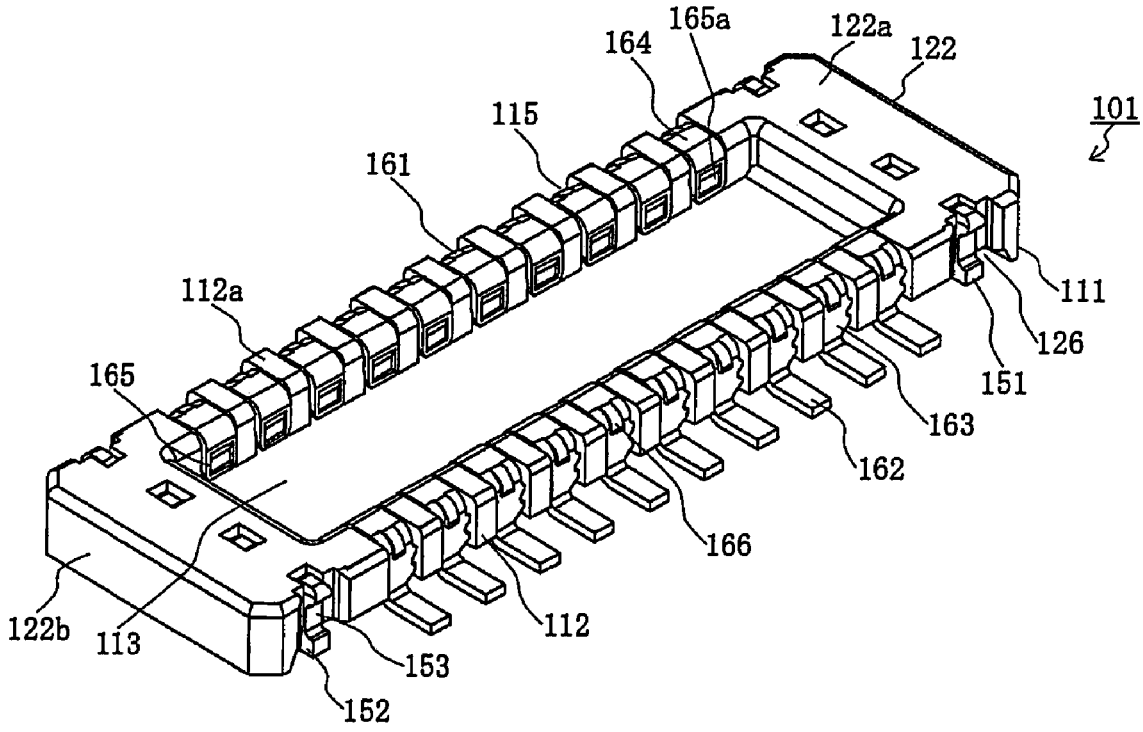
FIG. 3 is a perspective view of the second connector of FIG. 1, viewed from a fitting face.

Referring to FIG. 3, the second connector 101 includes a second housing 111 as a connector body integrally formed of an insulating material such as synthetic resin. As will be understood from the drawing figure, the second housing 111 is a generally rectangular parallelepiped member having a generally rectangular, thick plate-like shape. The second housing 111 has a dimension of about 8.0 mm in length, about 1.5 mm in width, and about 0.8 mm in thickness, and the dimension may be appropriately changed as required. Moreover, an elongated recessed cavity portion 113 configured to extend in the longitudinal direction of the second housing 111 and second protrusive convex portions 112 as an elongated protrusive convex portion configured to define the outer sides of the recessed cavity portion 113 and extend in the longitudinal direction of the second housing 111 are integrally formed on a side, i.e., a fitting side (the upper side in the drawing figure) of the second housing 111 where the first connector 1 is fitted. The second protrusive convex portions 112 are formed along both sides of the recessed cavity portion 113 and along both sides of the second housing 111. Moreover, second terminals 161 are arranged in each of the second protrusive convex portions 112.

As illustrated in the drawing figure, the recessed cavity portion 113 is closed by a bottom portion at a surface thereof on a side, i.e., a mounting surface (the lower surface side in the drawing figure) where it is mounted on the second board. Moreover, although in the example illustrated in the drawing figure, the number of second protrusive convex portions 112 is two, it may be singular in number and the number thereof is not particularly limited. The recessed cavity portion 113 has a dimension of about 0.7 mm in width, for example, and the dimension thereof may be appropriately changed as required.

The second terminals 161 are an integral member formed by applying processing, e.g., punching and bending to a conductive metal plate. Each of the second terminals 161 is provided with a holding portion 163 also functioning as a second contact portion, a tail portion 162 connected to a lower end of the holding portion 163, a connection portion 164 connected to an upper end of the holding portion 163, and a first contact portion 165 connected to an inner end of the connection portion 164. Moreover, concaved contact portions 165*a* configured to be engaged with the first contact portions 65 of the first terminals 61 are formed on the surface of the first contact portions 165. Furthermore, convexed contact portions 166 configured to be engaged with the second contact portions 66 of the first terminals 61 are formed in the vicinity of the upper ends of the holding portions 163.

The holding portions 163 are held with a perimeter thereof surrounded by the second housing 111 and make contact with the second contact portions 66 of the first terminals 61. The tail portions 162 are bent to be connected to the holding portions 163 and extend outwardly in the width direction of the second housing 111 to be connected to connection pads connected to a conductive trace on the second board by means of soldering or the like. The connection portions 164 are bent to be connected to the holding portions 163 and extend inwardly in the width direction of the second housing 111. The first contact portions 165 are portions that are bent to be connected to inner ends of the connection portions 164 and extend downwardly.

Moreover, second terminal receiving cavities 115 are formed along both side surfaces and an upper surface 112*a* of the second protrusive convex portion 112 so that the second terminals 161 are received in the second terminal receiving cavities 115. In the present embodiment, the upper surface 112*a* of the second protrusive convex portion 112 is a fitting face and is configured as a flat or smooth surface. The upper surface 112*a* as the fitting face functions as a reference surface for engagement between the first connector 1 and the second connector 101, together with the upper surface 13*a* of the first protrusive convex portion 13 of the first connector 1. Therefore, none of the portions of the upper surface of the connection portion 164 of the second terminals 161 protrude out from the upper surface 112*a*. Although the upper surface of the connection portion 164 is even with the upper surface 112*a* in the example illustrated in the drawing figure, it may be positioned at a lower side than the upper surface 112*a*.

The number of second terminal receiving cavities 115 on each side of the recessed cavity portion 113 is 10 with a pitch of about 0.4 mm, for example. Moreover, the number of second terminals 161 received in the second terminal receiving cavities 115 on each side of the recessed cavity portion 113 is 10 with a pitch of about 0.4 mm, for example. It should be appreciated that the pitch and the number of the second terminal receiving cavities 115 may be changed.

Furthermore, second protrusive end portions 122 as a second fitting guide portion are arranged at both ends in the longitudinal direction of the second housing 111, respectively. Each of the second protrusive end portions 122 is a thick member that extends in the short-axis direction of the second housing 111 and has both ends thereof connected to both ends in the longitudinal direction of the second protrusive convex portion 112, and an upper surface 122*a* thereof is a generally rectangular flat surface. Moreover, the second protrusive end portions 122 are portions which are inserted in the concaved protrusive end portions 22 of the first protrusive end portions 21 of the first connector 1 in a state where the first connector 1 and the second connector 101 are engaged by fitting together with each other. Furthermore, the upper surface 122*a* may be formed to be even with the upper surface 112*a* of the second protrusive convex portion 112 and may function as the fitting face together with the upper surface 112*a*.

Although in the example illustrated in the figure, the boundary portion between the outer end of the upper surface 122*a* and an outer side surface 122*b* of the second protrusive end portion 122, that is, corner portions on the surrounding three sides of the second protrusive end portion 122 are subjected to chamfering processing, the chamfering processing may be omitted.

Furthermore, second reinforcing brackets 151 as a reinforcing bracket are attached to the second protrusive end portions 122. The second reinforcing brackets 151 are an integral member formed by applying processing, e.g., punching and bending, to a metal plate and are received and held in second concave bracket holding portions 126 formed in the second protrusive end portion 122. Moreover, tail portions 152 formed at the lower ends of the second reinforcing brackets 151 are connected to fixing pads on the second board by means of soldering or the like. Furthermore, concave engagement portions 153 formed at the upper ends of the tail portions 152 are configured to be engaged with the convex engagement portions 53 of the first reinforcing brackets 51 of the first connector 1 in a state where the first connector 1 and the second connector 101 are engaged by fitting together with each other.

Figure 4:
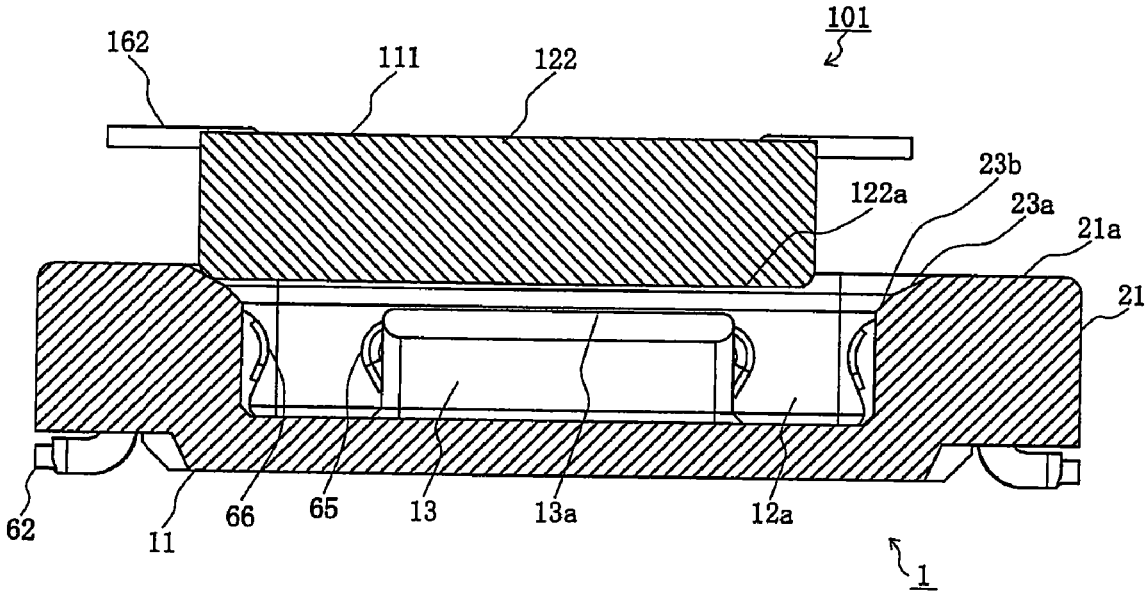
FIG. 4 is a cross-sectional view of the protrusive end portions of the connectors of FIG. 1, illustrating a first step of a fitting operation.
Figure 5:
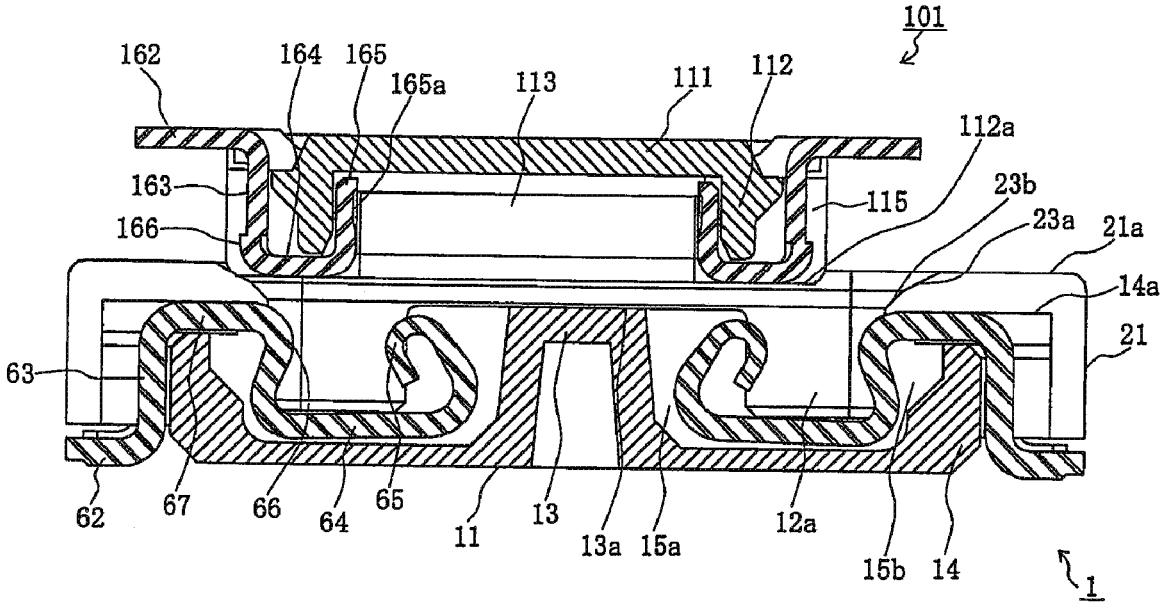
FIG. 5 is a cross-sectional view of the terminals of the connectors of FIG. 1, illustrating the first step of the fitting operation.
Figure 6:
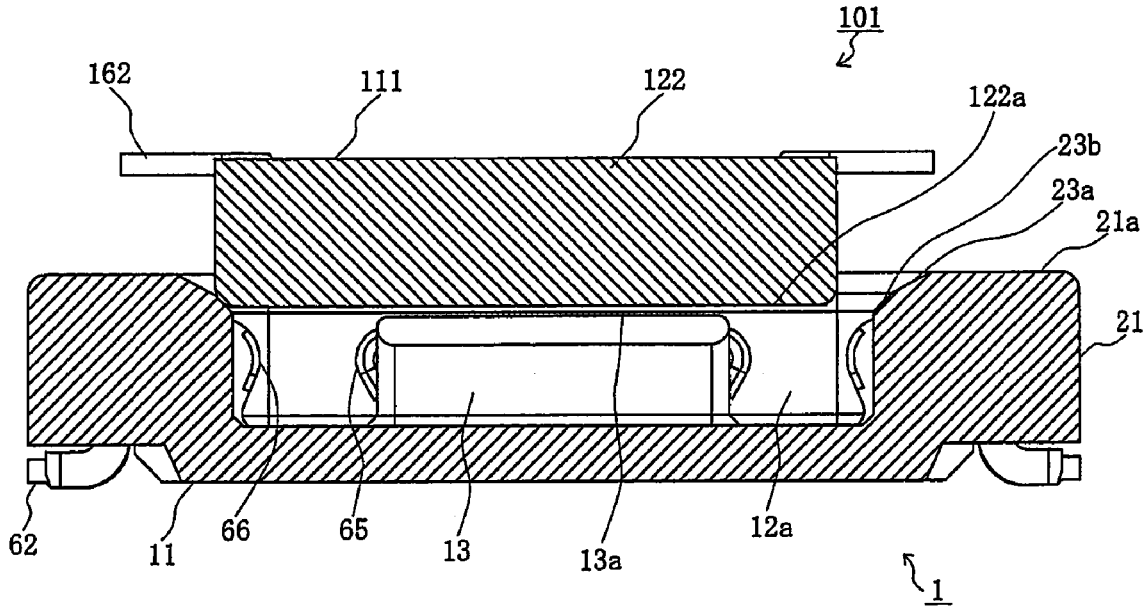
FIG. 6 is a cross-sectional view of the protrusive end portions of the connectors of FIG. 1, illustrating a second step of the fitting operation.
Figure 7:
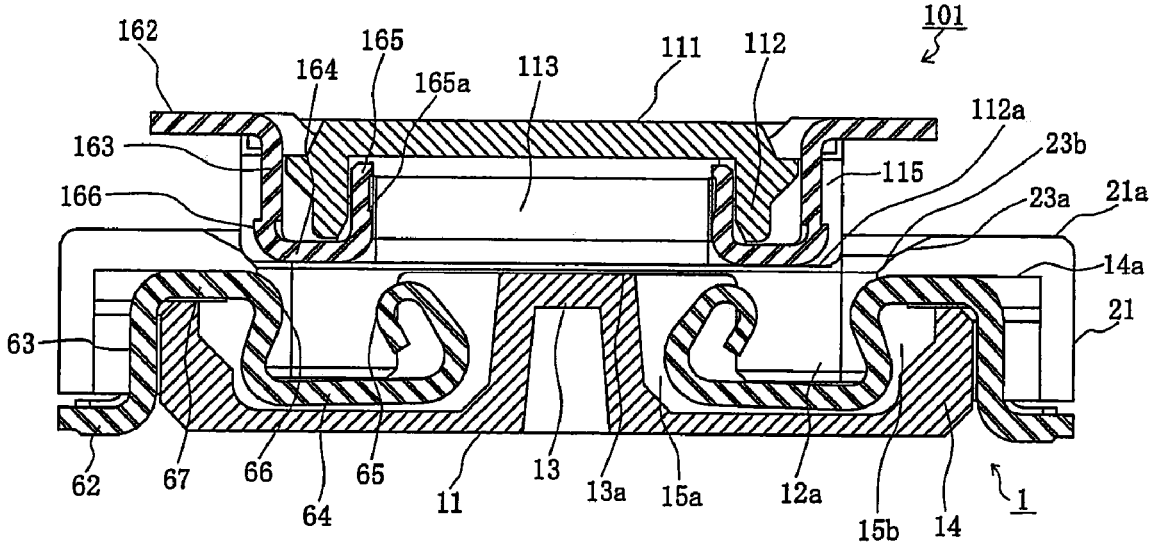
FIG. 7 is a cross-sectional view of the terminals of the connectors of FIG. 1, illustrating the second step of the fitting operation.
Figure 8:
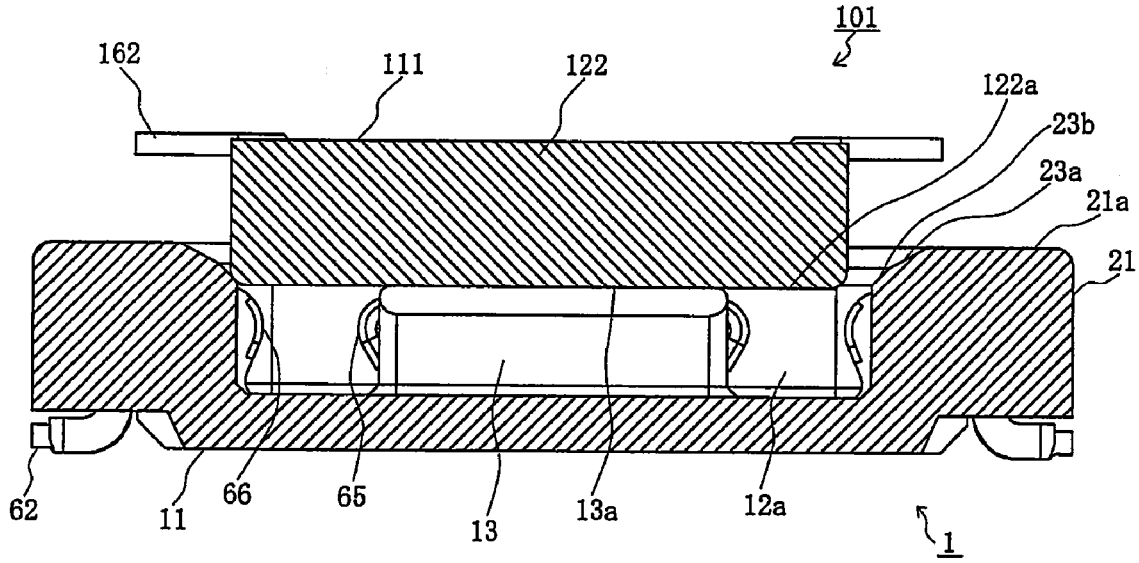
FIG. 8 is a cross-sectional view of the protrusive end portions of the connectors of FIG. 1, illustrating a third step of the fitting operation.
Figure 9:
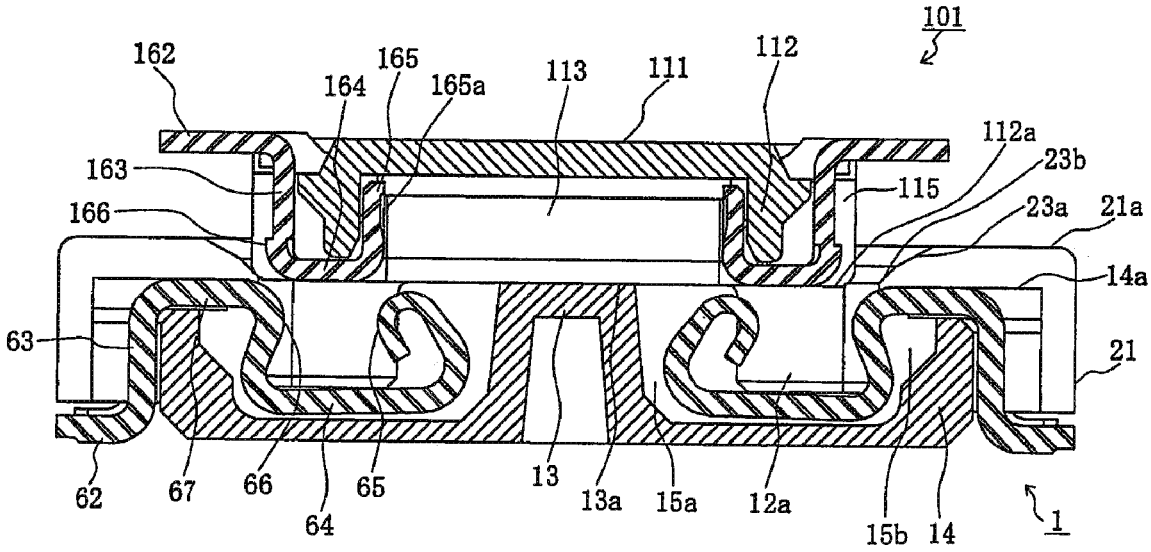
FIG. 9 is a cross-sectional view of the terminals of the connectors of FIG. 1, illustrating the third step of the fitting operation.
Figure 10:
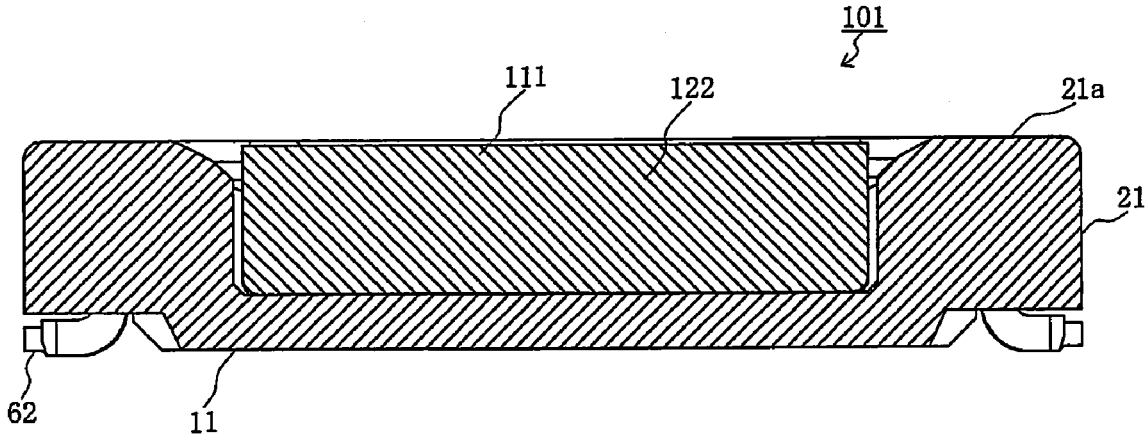
FIG. 10 is a cross-sectional view of the protrusive end portions of the connectors of FIG. 1, wherein the connectors are engaged together.
Figure 11:
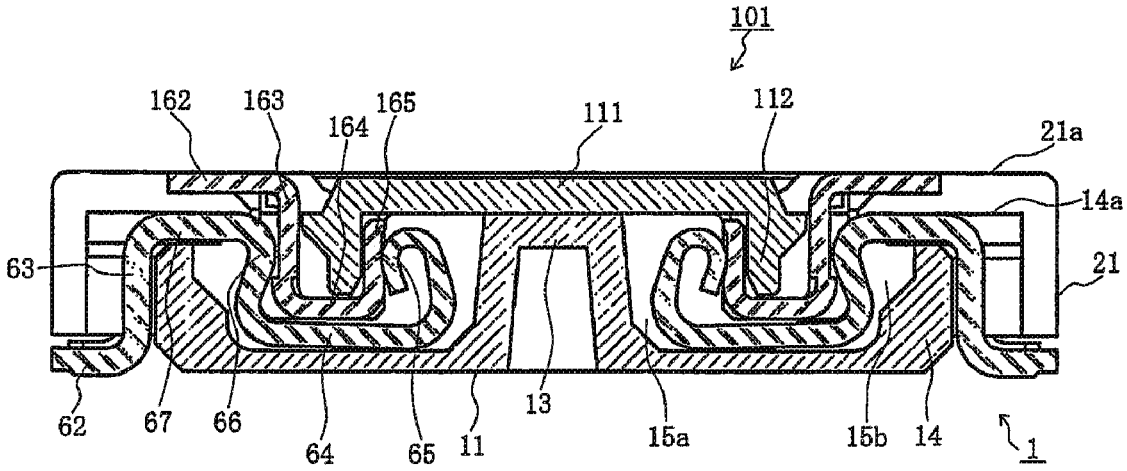
FIG. 11 is a cross-sectional view of the terminals of the connectors of FIG. 1, wherein the connectors are engaged together.
Figure 12:
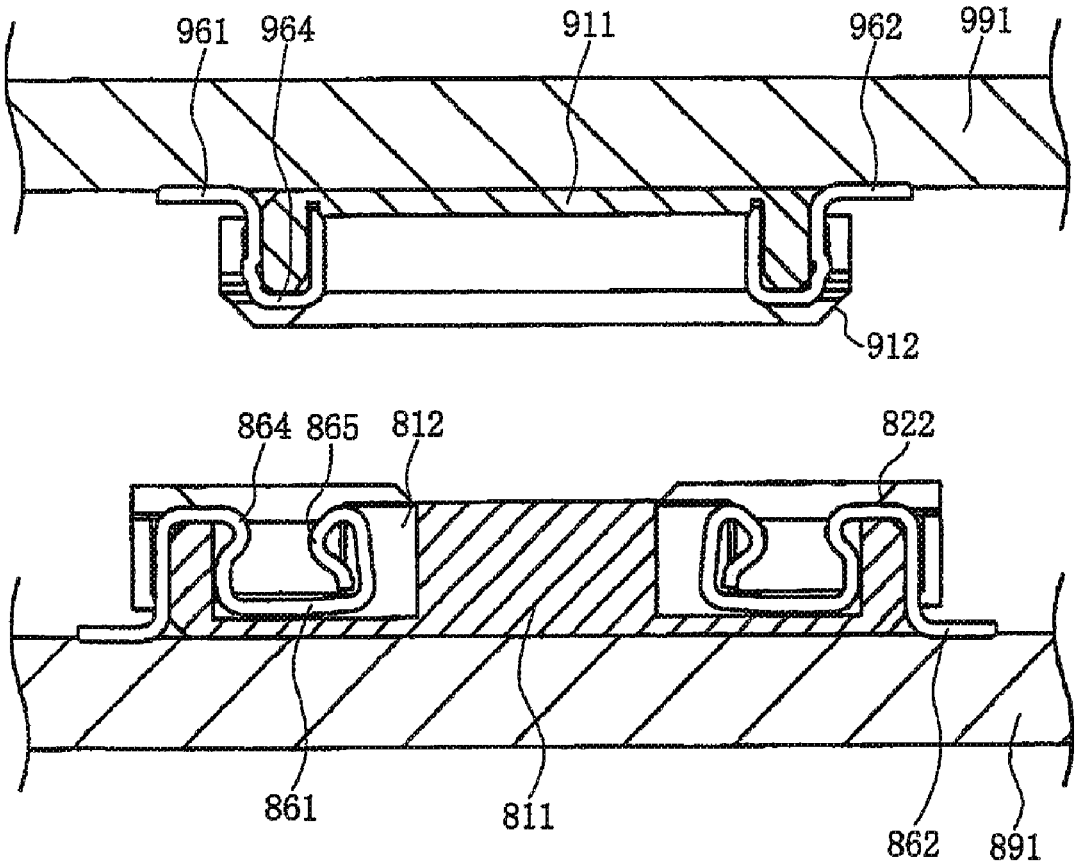
FIG. 12 Prior art
FIG. 12 is a cross-sectional view of a conventional board-to-board connector.

FIG. 4 is a cross-sectional view of the protrusive end portions of the connectors according to the embodiment of the Present Disclosure, illustrating a first step of a fitting operation; FIG. 5 is a cross-sectional view of the terminals of the connectors according to the embodiment of the Present Disclosure, illustrating the first step of the fitting operation; FIG. 6 is a cross-sectional view of the protrusive end portions of the connectors according to the embodiment of the Present Disclosure, illustrating a second step of the fitting operation; FIG. 7 is a cross-sectional view of the terminals of the connectors according to the embodiment of the Present Disclosure, illustrating the second step of the fitting operation; FIG. 8 is a cross-sectional view of the protrusive end portions of the connectors according to the embodiment of the Present Disclosure, illustrating a third step of the fitting operation; FIG. 9 is a cross-sectional view of the terminals of the connectors according to the embodiment of the Present Disclosure, illustrating the third step of the fitting operation; FIG. 10 is a cross-sectional view of the protrusive end portions of the connectors according to the embodiment of the Present Disclosure, illustrating a state where the connectors are engaged, by fitting, with each other; FIG. 11 is a cross-sectional view of the terminals of the connectors according to the embodiment of the Present Disclosure, illustrating a state where the connectors are engaged, by fitting, with each other.

In this embodiment, the first connector 1 is assumed to be surface-mounted on the first board in a state where the tail portions 62 of the first terminals 61 are connected to connection pads connected to a non-illustrated conductive trace on the first board by means of soldering or the like and the tail portions 52 of the first reinforcing brackets 51 are connected to the fixing pads on the first board by means of soldering or the like.

As illustrated in FIG. 5, the front ends of the second contact portions 66 are projected from the first terminal-receiving outside cavities 15*b* of the side wall portions 14 to be received in the recessed groove portions 12*a*, and the front ends of the first contact portions 65 are projected from the first terminal-receiving inside cavities 15*a* of the first protrusive convex portions 13 to be received in the recessed groove portions 12*a*. Owing to this configuration, as illustrated in FIG. 11, the second terminals 161 of the second connector 101 inserted into the recessed groove portions 12*a* can be clamped by the first contact portions 65 and the second contact portions 66 in a sandwich manner. Moreover, the first contact portions 65 and the second contact portions 66 are approximately at the same position in the thickness direction of the first housing 11 and oppose each other.

Similarly, the second connector 101 is assumed to be surface-mounted on the second board in a state where the tail portions 162 of the second terminals 161 are connected to connection pads connected to a non-illustrated conductive trace on the second board by means of soldering or the like and the tail portions 152 of the second reinforcing brackets 151 are connected to the fixing pads on the second board by means of soldering or the like.

As illustrated in FIG. 5, the first contact portions 165 are arranged to be exposed while extending along the inner side walls of the second protrusive convex portions 112, and the holding portions 163 are positioned inside the second terminal receiving cavities 115. Moreover, the concaved contact portions 165*a* are formed on the surfaces of the first contact portions 165, and the convexed contact portions 166 are formed on the surfaces of the holding portions 163. Owing to this configuration, as illustrated in FIG. 11, the first contact portions 165 and the holding portions 163 of the second terminals 161 of the second connector 101, inserted in the recessed groove portions 12*a* can make contact with the first contact portions 65 and the second contact portions 66 of the first terminals 61, respectively, in which the first and second contact portions 65 and 66 clamp the second terminals 161 in a sandwich manner.

Moreover, the second contact portions 66 of the first terminals 61 engage with the convexed contact portions 166 of the second terminals 161, and the first contact portions 65 of the first terminals 61 engage with the concaved contact portions 165*a* of the second terminals 161. Therefore, it is difficult to remove the second connector 101 from the first connector 1 upon receipt of a force that releases the fitting engagement between the first connector 1 and the second connector 101, that is, upon receipt of a removal force for removing the second connector 101 from the first connector 1. That is, a necessary removal force is increased.

In this embodiment, since the first connector 1 and the second connector 101 are mounted on the first board and the second board having a large area, respectively, it will be described that an operator performs a fumbling fitting operation in a state of being unable to see the fitting face side of the first connector 1 and the fitting face side of the second connector 101.

First, the operator moves the first connector 1 and/or the second connector 101 in a direction toward either one of the connectors, i.e., in the fitting direction, in a state where the fitting face of the first connector 1 opposes the fitting face of the second connector 101 so that the first connector 1 makes abutting contact with the second connector 101. In this case, since the operator performs the fitting operation in a fumbling manner, the positioning cannot be performed in an accurate manner, and thus, as illustrated in FIGS. 4 and 5, the central axis of the first connector 1 is misaligned with respect to the central axis of the second connector 101.

Specifically, the central axis of the second connector 101 is positioned at the left side in the drawing figures with respect to the central axis of the first connector 1, so that the left corner portions in the drawing figures of the upper surface 122*a* of the second protrusive end portion 122 of the second housing 111 are in abutting contact with the anterior sloped surface portion 23*a* formed in the left corner portions in the drawing figures of the concaved protrusive end portion 22 of the first protrusive end portion 21 of the first housing 11.

Here, when the operator moves the second connector 101 in the fitting direction relative to the first connector 1, the left corner portions in the drawing figures of the upper surface 122*a* are moved along the anterior sloped surface portion 23*a*, so that the second connector 101 is moved rightward in the drawing figures relative to the first connector 1. That is, the central axis of the second connector 101 is moved in a direction perpendicular to the fitting direction, i.e., in a direction toward the central axis of the first connector 1.

Therefore, the operator is able to easily perceive that the first connector 1 is misaligned with respect to the second connector 101 and that the position of the second connector 101 is misaligned leftward in the drawing figures with respect to the first connector 1.

Moreover, since the anterior sloped surface portion 23*a* has a gentle slope with respect to the fitting face, that is, a steep slope with respect to the fitting direction, an amount of movement of the second connector 101 in a direction perpendicular to the fitting direction with respect to the first connector 1 is large compared with an amount of the movement in the fitting direction. For this reason, the operator is able to perceive that the fitting face of the first connector 1 is still distant from the fitting face of the second connector 101 because the corner portions of the upper surface 122*a* are in abutting contact with the anterior sloped surface portion 23*a*.

Subsequently, when the operator further moves the second connector 101 in the fitting direction relative to the first connector 1, as illustrated in FIGS. 6 and 7, the misalignment between the central axis of the first connector 1 and the central axis of the second connector 101 decreases, and the left corner portions in the drawing figures of the upper surface 122*a* of the second protrusive end portion 122 of the second housing 111 make abutting contact with the posterior sloped surface portion 23*b* formed in the left corner portions in the figures of the concaved protrusive end portion 22 of the first protrusive end portion 21 of the first housing 11.

In such a state, when the operator further moves the second connector 101 in the fitting direction relative to the first connector 1, the left corner portions in the drawing figures of the upper surface 122*a* are moved along the posterior sloped surface portion 23*b*, so that the second connector 101 is moved rightward in the drawing figures relative to the first connector 1. That is, the central axis of the second connector 101 is moved in a direction perpendicular to the fitting direction, i.e., in a direction toward the central axis of the first connector 1.

Therefore, the operator is able to easily perceive that the first connector 1 is still misaligned with respect to the second connector 101 and that the position of the second connector 101 is still misaligned leftward in the figures with respect to the first connector 1.

Moreover, since the posterior sloped surface portion 23*b* has a steep slope with respect to the fitting face compared with the anterior sloped surface portion 23*a*, that is, has a gentle slope with respect to the fitting direction, an amount of movement of the second connector 101 in a direction perpendicular to the fitting direction with respect to the first connector 1 is small compared with an amount of the movement in the fitting direction. For this reason, the operator is able to perceive that the fitting face of the first connector 1 is in close contact with the fitting face of the second connector 101 because the corner portions of the upper surface 122*a* are in abutting contact with the posterior sloped surface portion 23*b*.

Subsequently, when the operator further moves the second connector 101 in the fitting direction relative to the first connector 1, as illustrated in FIGS. 8 and 9, an amount of misalignment between the central axis of the first connector 1 and the central axis of the second connector 101 decreases more, so that the fitting face of the first connector 1 becomes even with the fitting face of the second connector 101. That is, the upper surface 13*a* of the first protrusive convex portion 13 of the first housing 11 becomes even with the upper surface 112*a* of the second protrusive convex portion 112 and the upper surface 122*a* of the second protrusive end portion 122 of the second housing 111.

In this state, the left corner portions in the drawing figures of the upper surface 122*a* are in abutting contact with the lower end of the posterior sloped surface portion 23*b*, that is, the boundary portion with the inner side surface 21*d* on the left side in the drawing figures of the first protrusive end portion 21. Therefore, the outer side surface 122*b* on the left side in the drawing figures of the second protrusive end portion 122 of the second housing 111 is close to a state of being even with the inner side surface 21*d* on the left side in the drawing figures of the first protrusive end portion 21 of the first housing 11. Nevertheless, the outer side surface 122*b* on the right side in the drawing figures of the second protrusive end portion 122 is spaced apart from the inner side surface 21*d* on the right side in the drawing figures of the first protrusive end portion 21. Such horizontal variations result from inevitable dimensional errors of the first housing 11 and the second housing 111.

Since the first housing 11 and the second housing 111 are products, some extent of dimensional errors is inevitable. Therefore, it is practically impossible that a dimension between the left and right inner side surfaces 21*d* of the first protrusive end portion 21 is exactly identical with a dimension between the left and right outer side surfaces 122*b* of the second protrusive end portion 122. Moreover, it is inevitable that when the inner side surface 21*d* and the outer side surface 122*b* are aligned on one side, the inner side surface 21*d* and the outer side surface 122*b* must be misaligned on the other side.

The same statements can be applied to the horizontal positional relationship between the first terminals 61 and the second terminals 161. In the example illustrated in FIG. 9, the first terminals 61 and the second terminals 161 are substantially aligned with each other in the left-right direction on the left side; however, the first terminals 61 and the second terminals 161 are misaligned to some extent in the left-right direction on the right side.

Moreover, as illustrated in FIG. 9, where the fitting face of the first connector 1 is even with the fitting face of the second connector 101, the respective portions of the first terminals 61 and the respective portions of the second terminals 161 are spaced apart from each other in the fitting direction or in a direction perpendicular to the fitting direction. Therefore, none of the portions of the first terminals 61 are in abutting contact with the second terminals 161.

Subsequently, when the operator further moves the second connector 101 in the fitting direction relative to the first connector 1, the fitting engagement between the first connector 1 and the second connector 101 starts. Then, the second protrusive convex portions 112 on the left and right sides of the second connector 101 are inserted into the recessed groove portions 12*a* on the left and right sides of the first connector 1 so that the first contact portions 65 of the first terminals 61 are brought into contact with the first contact portions 165 of the second connector 161, and the second contact portions 66 of the first terminal 61 are brought into contact with the holding portions 163 of the second terminals 161.

In this way, as illustrated in FIGS. 10 and 11, when the fitting engagement between the first connector 1 and the second connector 101 is completed, the first terminals 61 and the second terminals 161 are electrically connected to each other. As a result, the conductive trace connected to the connection pads on the first board being connected to the tail portions 62 of the first terminals 61 are electrically connected to the conductive trace connected to the connection pads on the second board being connected to the tail portions 162 of the second terminals 161. In this case, since the first terminals 61 and the second terminals 161 make multi-point contact with each other, it is possible to certainly maintain stable electrical connection.

Moreover, the first contact portions 65 of the first terminals 61 are in a state where they are engaged with the concaved contact portions 165*a* of the second terminals 161, while the second contact portions 66 of the first terminals 61 are in a state where they are engaged with the concaved contact portions 166 of the second terminals 161. Furthermore, the convex engagement portions 53 of the first reinforcing brackets 51 of the first connector 1 are in a state where they are engaged with the concave engagement portions 153 of the second reinforcing brackets 151 of the second connector 101. Owing to this configuration, it is difficult to remove the second connector 101 from the first connector 1 even upon receipt of a force that releases the fitting between the first connector 1 and the second connector 101, that is, upon receipt of a removal force for removing the second connector 101 from the first connector 1. That is, a necessary removal force is increased.

Furthermore, since the first terminal 61 has elastic properties, the distance between the first contact portion 65 and the second contact portion 66 can be increased by the second terminal 161 being positioned between them. Moreover, the upper end portions of the first contact portion 65 and the second contact portions 66 have a curved surface shape that is outwardly opened, so that the distance between the first contact portion 65 and the second contact portion 66 increases as it goes upward. In addition, the connecting portion of the connection portion 164 of the second terminal 161 and the holding portion 163 and the first contact portion 165 has a curved surface shape. Owing to such a configuration, even when the first terminal 61 and the second terminal 161 are misaligned to some extent in the left-right direction, when the second connector 101 is moved downward, the second terminal 161 is caused to be positioned between the first contact portion 65 and the second contact portion 66 of the first terminal 61 and is thus automatically aligned. That is, self-alignment is carried out.

Therefore, as long as the fitting face of the first connector 1 is in a state of being even with the fitting face of the second connector 101, as illustrated in FIG. 9, since the amount of the horizontal misalignment between the first terminal 61 and the second terminal 161 is small, the operator is able to complete the fitting operation merely by further moving the second connector 101 in the fitting direction relative to the first connector 1 so that the second terminal 161 comes to be positioned between the first contact portion 65 and the second contact portion 66.

That is, after the fitting face of the first connector 1 has become even with the fitting face of the second connector 101, it is not necessary to perform the positioning by moving the second connector 101 in the left-right direction in the drawing figures, i.e., perpendicular to the fitting direction, relative to the first connector 1, but the fitting operation can be completed merely by moving the second connector 101 in the fitting direction with respect to the first connector 1.

As described above, in the present embodiment, even when the fitting face of the first connector 1 becomes even with the fitting face of the second connector 101, the first terminals 61 and the second terminals 161 are not in abutting contact with each other but are spaced apart from each other. Owing to such a configuration, during steps performed until the fitting face of the first connector 1 becomes even with the fitting face of the second connector 101 after the operator has started the fumbling fitting operation, that is, in a state where the first connector 1 and the second connector 101 are not yet engaged with each other, even when the second connector 101 is moved, in the fumbling manner, relative to the first connector 1 in the left-right direction in FIGS. 4 to 11, i.e., in a direction perpendicular to the fitting direction, the first terminals 61 and the second terminals 161 are not brought into abutting contact with each other, so that they do not rub against each other and might not be damaged.

When the fitting face of the first connector 1 has become even with the fitting face of the second connector 101, the fitting engagement between the first connector 1 and the second connector 101 is actually started in the true sense of the meaning, and thereafter, the first terminals 61 and the second terminals 161 make abutting contact with each other. In this case, after the fitting engagement between the first connector 1 and the second connector 101 has been started, since it is only necessary to move the second connector 101 in the fitting direction with respect to the first connector 1 but not in the direction perpendicular to the fitting direction, the first terminals 61 and the second terminals 161 might not rub against each other.

Moreover, since the second terminal 161 comes to be positioned between the first contact portion 65 and the second contact portion 66 of the first terminal 61 until completion of the fitting engagement between the first connector 1 and the second connector 101 after it is started, a portion of the first terminal 61 may rub against a portion of the second terminal 161. However, the damages to the first terminal 61 and the second terminal 161 caused by the rubbing are unavoidable because the first terminal 61 and the second terminal 161 are structured to be firmly attached with each other to thereby certainly maintain stable electrical connection. To the contrary, the contact between the first terminal 61 and the second terminal 161 during steps performed until the fitting face of the first connector 1 becomes even with the fitting face of the second connector 101 can be avoided if the operator is able to see the fitting side of the first connector 1 and the fitting side of the second connector 101 and it is thus not necessary to move the second connector 101 with respect to the first connector 1 in the direction perpendicular to the fitting direction in the fumbling manner.

In other words, in accordance with the present embodiment, it is possible to certainly prevent damages of the first terminals 61 and the second terminals 161 occurring when the operator has to perform the fumbling fitting operation in a state of being unable to see the fitting side of the first connector 1 and the fitting side of the second connector 101.

Moreover, in the present embodiment, the sloped surface portion 23 formed in the corner portion of the concaved protrusive end portion 22 is provided with the anterior sloped surface portion 23*a* having a gentle slope with respect to the fitting face and the posterior sloped surface portion 23*b* having a steep slope with respect to the fitting face. Owing to such a configuration, the second protrusive end portion 122 of the second housing 111 can be smoothly guided into the concaved protrusive end portion 22 of the first protrusive end portion 21 of the first housing 11. Therefore, it is easy to align the second connector 101 with respect to the first connector 1.

Furthermore, in the present embodiment, although the direction perpendicular to the fitting direction has been described as being the horizontal direction in FIGS. 4 to 11, i.e., the width direction of the first housing 11 and the second housing 111, the same statements can be applied to a case where the direction perpendicular to the fitting direction corresponds to a direction perpendicular to the drawing sheet of FIGS. 4 to 11, i.e., the longitudinal direction of the first housing 11 and the second housing 111. In other words, when the operator moves the second connector 101 in the fumbling manner relative to the first connector 1 in the direction perpendicular to the drawing sheet, the same effect is obtained by performing similar operations.

The Present Disclosure is not limited to the above-described embodiments, and may be changed or modified in various ways based on the gist of the Present Disclosure, and these changes and modification are not eliminated from the scope of the Present Disclosure as claimed in the attached Claims.

What is claimed is:

1. A board-to-board connector, the board-to-board connector comprising:

a first connector, the first connector including a first housing mounting thereon first terminals, the first housing including:

an island portion formed, on an upper side thereof, with a fitting face;

concave insertion portions formed on both sides of the island portion;

side wall portions formed on both sides of each concave insertion portion;

first fitting guide portions arranged at both ends in a longitudinal direction of each island portion; and concave guide portions formed in each first fitting guide portion, and a second connector configured to engage the first connector, the second connector including a second housing mounting thereon second terminals configured to make contact with the first terminals, the second housing including:

a recessed cavity portion in which the island portion is inserted;

protrusive convex portions formed on both sides of the recessed cavity portion to have fitting faces formed thereon and provided to be inserted in the concave insertion portions; and second fitting guide portions arranged at both ends in the longitudinal direction of the recessed cavity portion to be inserted in the concave guide portions;

wherein:

at least part of an entrance end portion of each of the concave guide portions is provided with a sloped guide surface formed therein, each sloped guide surface comprising an anterior sloped surface portion having a defined gentle slope and a posterior sloped surface portion having a defined steep slope with respect to the fitting face of the first connector, the anterior sloped surface portion and the posterior sloped surface portion sharing a common edge; and due to insertion of the second fitting guide portions in the concave guide portions so that portions of the second fitting guide portions are brought into abutting contact with the sloped guide surfaces, the first terminals and the second terminals are spaced apart from each other in a state where the fitting face of the first housing and the fitting faces of the second housing are even with each other.

2. The board-to-board connector of claim 1, wherein the fitting face of the first housing is formed to be flat.

3. The board-to-board connector of claim 2, wherein none of the portions of the first terminals protrude out from the fitting face.

4. The board-to-board connector of claim 3, wherein the fitting faces of the second housing are formed to be flat.

5. The board-to-board connector of claim 4, wherein none of the portions of the second terminals protrude out from the fitting faces.

6. The board-to-board connector of claim 5, wherein each first terminal is provided with a first contact portion and a second contact portion defining therebetween a mutual gap which is elastically changeable.

7. The board-to-board connector of claim 6, wherein, when the protrusive convex portions are inserted in the concave insertion portions, a respective one of the second terminals comes to be positioned between the first contact portion and the second contact portion.

8. The board-to-board connector of claim 1, wherein each first terminal is provided with a first contact portion and a second contact portion defining therebetween a mutual gap which is elastically changeable.

9. The board-to-board connector of claim 8, wherein, when the protrusive convex portions are inserted in the concave insertion portions, a respective one of the second terminals comes to be positioned between the first contact portion and the second contact portion.

* * * * *